US009897018B2

(12) United States Patent
Kato et al.

(10) Patent No.: US 9,897,018 B2
(45) Date of Patent: Feb. 20, 2018

(54) VEHICLE SPEED CONTROL APPARATUS OF INDUSTRIAL VEHICLE

(71) Applicant: KABUSHIKI KAISHA TOYOTA JIDOSHOKKI, Kariya-shi, Aichi-ken (JP)

(72) Inventors: Norihiko Kato, Aichi-ken (JP); Yukikazu Koide, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 319 days.

(21) Appl. No.: 14/487,734

(22) Filed: Sep. 16, 2014

(65) Prior Publication Data

US 2015/0081191 A1 Mar. 19, 2015

(30) Foreign Application Priority Data

Sep. 18, 2013 (JP) ..... 2013-192778

(51) Int. Cl.
*F02D 31/00* (2006.01)
*F02D 41/00* (2006.01)
*F02D 41/14* (2006.01)

(52) U.S. Cl.
CPC ..... *F02D 31/001* (2013.01); *F02D 31/006* (2013.01); *F02D 31/009* (2013.01); *F02D 2041/0022* (2013.01); *F02D 2041/1409* (2013.01)

(58) Field of Classification Search
None
See application file for complete search history.

(56) References Cited

U.S. PATENT DOCUMENTS 6,278,915 B1 * 8/2001 Deguchi ..... B60K 6/543 180/65.235
6,782,961 B1 * 8/2004 Ishikawa ..... B60K 28/16 180/197
2002/0107106 A1 * 8/2002 Kato ..... B60K 31/0008 477/110
2004/0158385 A1 * 8/2004 Nakano ..... B60K 31/04 701/104
2005/0071064 A1 * 3/2005 Nakamura ..... F02D 29/04 701/50

(Continued)

FOREIGN PATENT DOCUMENTS

DE 102008054781 A1 6/2010
EP 0333702 A2 9/1989

(Continued)

OTHER PUBLICATIONS

Communication dated Mar. 12, 2015, issued by the European Patent Office in corresponding application No. 14185067.7.

(Continued)

*Primary Examiner* — Jonathan M Dager
(74) *Attorney, Agent, or Firm* — Sughrue Mion, PLLC

(57) ABSTRACT

A vehicle speed control apparatus of an industrial vehicle has a controller that determines a target engine speed by PI control based on a deviation between a target vehicle speed and an actual vehicle speed. The controller controls an upper limit of the target engine speed according to an actual engine speed.

4 Claims, 2 Drawing Sheets

(56) References Cited

U.S. PATENT DOCUMENTS

2007/0137338 A1* 6/2007 Nishi ..... F16H 61/423 74/335
2007/0208484 A1* 9/2007 Tsujimura ..... B60T 7/22 701/93
2010/0138118 A1* 6/2010 Tsukada ..... B60W 10/06 701/50
2011/0004381 A1* 1/2011 Yamada ..... F16H 59/44 701/55
2011/0178684 A1* 7/2011 Umemoto ..... F16H 61/421 701/51
2011/0238272 A1* 9/2011 Kato ..... B60W 10/06 701/55
2012/0197509 A1* 8/2012 Watanabe ..... F02D 9/02 701/102
2013/0238219 A1* 9/2013 Ando ..... F02D 41/22 701/102
2014/0000556 A1* 1/2014 Nakamura ..... F02D 41/30 123/325
2014/0020375 A1* 1/2014 Fujishima ..... B60W 20/00 60/431
2014/0283509 A1* 9/2014 Hijikata ..... F15B 11/044 60/414
2014/0290236 A1* 10/2014 Aizawa ..... F16H 39/02 60/443
2015/0008054 A1* 1/2015 Hoshino ..... E02F 9/2075 180/65.26
2015/0033718 A1* 2/2015 Kaneko ..... F16H 61/431 60/327
2016/0200300 A1* 7/2016 Ishida ..... B60T 8/175 701/83
2016/0311432 A1* 10/2016 Kaneko ..... F16H 61/47

FOREIGN PATENT DOCUMENTS

EP 2415994 A1 2/2012
GB 2141268 A 12/1984
JP 5-16698 A 1/1993
JP 07-011987 A 1/1995
JP 2000-345871 A 12/2000
JP 2001-282357 A 10/2001
JP 2008-168914 A 7/2008

OTHER PUBLICATIONS

Communication dated Sep. 27, 2016, from the Japanese Patent Office in counterpart Japanese application No. 2013-192778.

* cited by examiner

VEHICLE SPEED CONTROL APPARATUS OF INDUSTRIAL VEHICLE

BACKGROUND OF THE INVENTION

The present invention relates to a vehicle speed control apparatus of an industrial vehicle.

Japanese Patent Application Publication No. 7-11987 discloses a control apparatus of a forklift truck having a structure wherein the accelerator pedal is not connected to a throttle valve of an engine of the forklift truck and the control apparatus is configured to control the traveling speed of the forklift truck for an optimum fuel consumption, as well as to provide ordinary speed. Specifically, for achieving a target engine speed for low fuel consumption rate according to a throttle opening of an engine, the control apparatus is configured to control the throttle opening and transmission ratio of HST (Hydraulic Static Transmission) by feedback control based on vehicle speed and engine speed.

The control apparatus of the above-cited publication adopts feedback control for vehicle speed control. In the vehicle speed control by feedback control, engine output power is determined based on the deviation between a target vehicle speed and an actual vehicle speed. The deviation of the vehicle speed is decreased with a decrease of the target vehicle speed. For example, when the lift of a forklift truck is being raised by inching operating of the pedal, the forklift truck may fail to increase the engine speed to the desired level. Especially, in a forklift truck, in which the engine supplies power not only for traveling, but also for load handling unlike a passenger car, the engine speed needs to be increased to a level that is enough for the engine to supply required power for load handling, as well as for traveling, irrespective of a target vehicle speed. That is, the feedback gain of the vehicle control apparatus needs to be large. This is also true for a traction vehicle. In this case, the required power is depending on the presence or absence of any object to be towed and the load of the object.

In contrast, in the case of starting a vehicle wherein the deviation between a target vehicle speed and an actual vehicle speed is large, the target engine speed becomes too high if feedback gain is large, so that the vehicle may be accelerated excessively or overshoot in the vehicle speed may occur.

In the case of a gasoline engine whose response to a command for increasing the engine speed is slow, time lag occurs in increasing the engine speed and the deviation for feedback control is accumulated, so that the target engine speed becomes too large and overshoot in the vehicle speed tends to occur. In the case of a diesel engine whose response to the command is faster than in the gasoline engine, the vehicle tends to be accelerated excessively immediately after starting a vehicle and when the deviation of the vehicle speed is large.

The present invention which has been made in light of the problems described above is directed to providing a vehicle speed control apparatus of an industrial vehicle which prevents excessive acceleration of a vehicle and overshoot of a vehicle speed while securing an engine speed required for load handling.

SUMMARY OF THE INVENTION

In accordance with an aspect of the present invention, a vehicle speed control apparatus of an industrial vehicle has a controller that determines a target engine speed by PI control based on a deviation between a target vehicle speed and an actual vehicle speed. The controller controls an upper limit of the target engine speed according to an actual engine speed.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
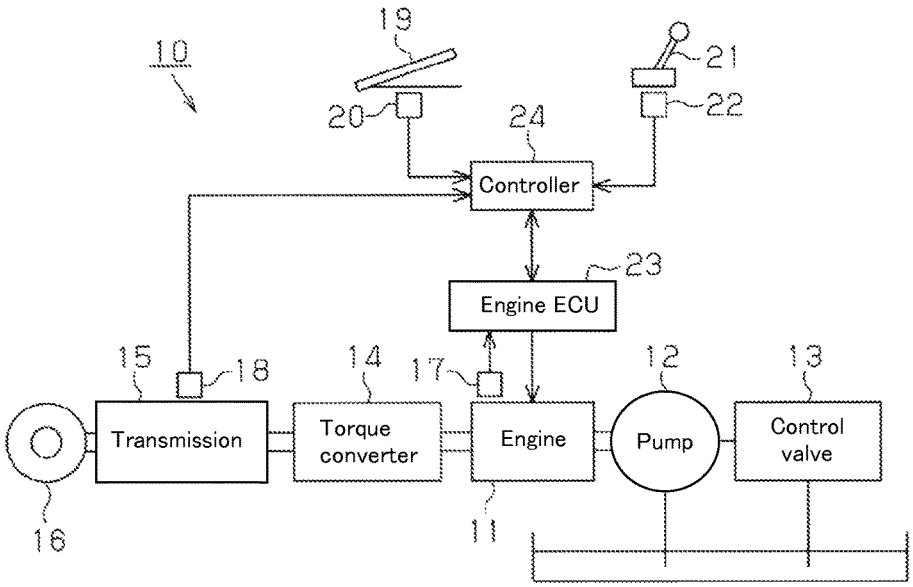
FIG. 1 is a schematic diagram showing a configuration of a vehicle speed control apparatus according to an embodiment of the present invention.

The following will describe a vehicle speed control apparatus of a forklift truck as an industrial vehicle according to the embodiment of the present invention with reference to FIGS. 1 through 4. Referring to FIG. 1, the forklift truck that is designated by reference numeral 10 includes an engine 11, a hydraulic pump 12, a control valve 13, a torque converter 14 and a transmission 15 as the power system of the forklift truck 10. A diesel engine is used as the engine 11. The hydraulic pump 12 is driven by the engine 11. The control valve 13 controls the flow of hydraulic oil for a lift cylinder and a tilt cylinder of a load handling system of the forklift truck 10 through tubes (not shown). Power of the engine 11 is transmitted through the torque converter 14 to the transmission 15, from which the power is further transmitted through a forward or reverse clutch that is provide in the transmission 15 and not shown to the drive wheels 16, thus allowing the forklift truck 10 to travel.

The forklift truck 10 further includes several sensors that are used for travel control and engine control. The engine 11 has an engine speed sensor 17 for detecting an engine speed of the engine 11 and generating a detection signal (an engine speed signal) according to the detected engine speed. The transmission 15 has a vehicle speed sensor 18 for detecting the vehicle speed by measuring the speed of a gear that is fixed on the output shaft of the transmission 15 and generating a detection signal according to the detected vehicle speed.

The forklift truck 10 further includes an accelerator pedal 19 that is not connected to a throttle valve of the engine 11 and serves as a means for controlling the acceleration. The accelerator pedal 19 has an accelerator pedal sensor 20 for detecting the amount of depression of the accelerator pedal 19 and generating a detection signal according to the detected depression amount of the accelerator pedal 19.

The forklift truck 10 further includes a lift lever 21 that is used for load handling. The lift lever 21 is connected to a lift lever sensor 22 serving as a means for detecting the lift amount. The lift lever sensor 22 generates a detection signal according to the detected lift amount of the lift lever 21.

The forklift truck 10 further includes an engine ECU (electronic control unit) 23 for controlling the engine 11 and a controller 24 for controlling the forklift truck 10. The engine ECU 23 and the controller 24 are electrically bidirectionally connected and cooperate to form a part of the vehicle speed control apparatus.

The engine ECU 23 has a CPU (central processing unit) and a memory unit in which control programs and mapped data are stored for controlling the engine 11. The engine ECU 23 controls the engine 11 in such a way that the engine speed becomes the target engine speed commanded by the controller 24.

Figure 2:
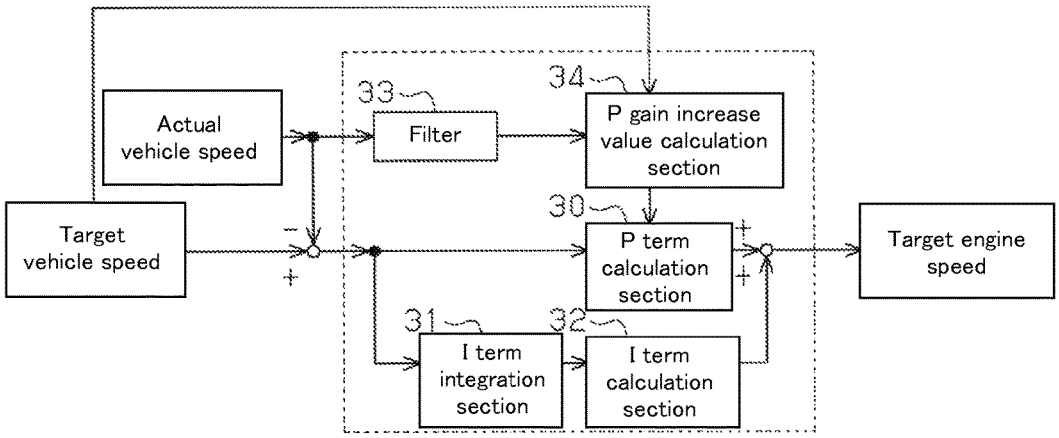
FIG. 2 is a block diagram showing a procedure for calculation of the target engine speed for the vehicle speed control apparatus of FIG. 1.

The controller 24 has a CPU and a memory unit in which control programs for controlling the traveling and load handling of the forklift truck 10 are stored. FIG. 2 shows an example of a control program stored in the memory unit for determining the target engine speed. In FIG. 2, the part of the program enclosed by dotted line is different from the program used in the conventional apparatus. Mapped data for controlling traveling and load handling of the forklift truck 10 is also stored in the memory unit. The controller 24 controls traveling and load handling of the forklift truck 10 based on input data of detection signals from the engine speed sensor 17, the vehicle speed sensor 18, the accelerator pedal sensor 20 and the lift lever sensor 22.

Figure 3:
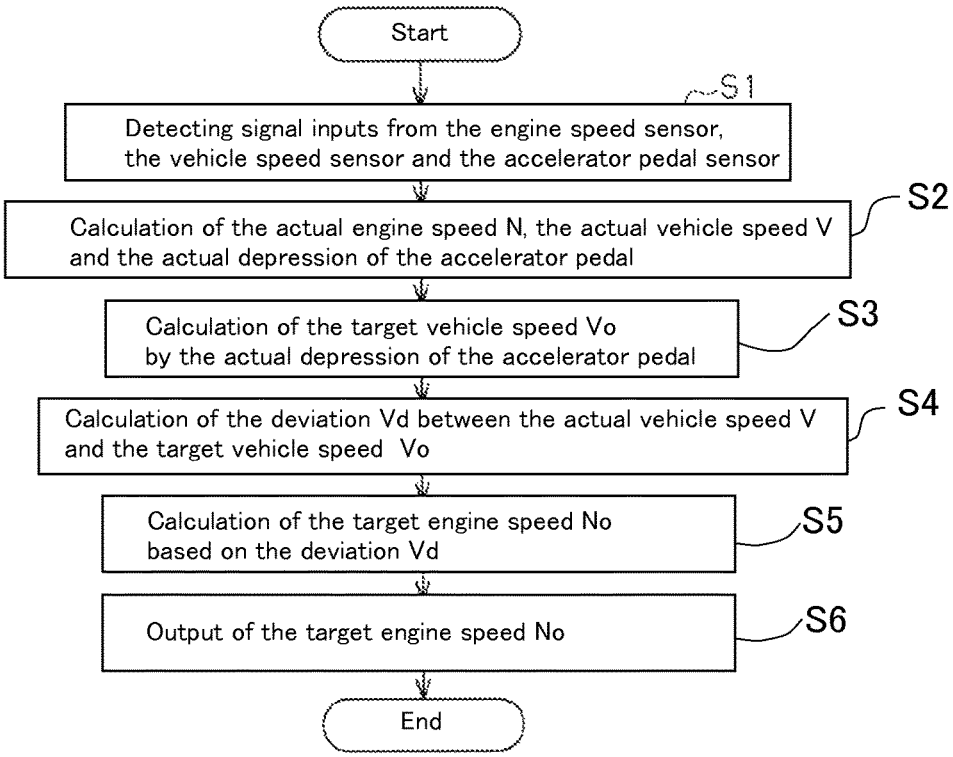
FIG. 3 is a flow chart showing the controlling of the vehicle speed control apparatus of FIG. 1.

Referring to FIGS. 2 and 3, the following will describe the operation of vehicle speed controlling by the vehicle speed control apparatus having the above-described configuration. The controller 24 calculates a target engine speed No in terms of RPM at a predetermined control time interval according to the flow chart shown in FIG. 3 and generates a signal indicative of the calculated target engine speed No to the engine ECU 23. Based on the input data of the target engine speed No from the controller 24, the engine ECU 23 controls the engine 11 so that the engine speed becomes the target engine speed No.

Specifically, in the step S1 of FIG. 3, the controller 24 receives detection signals from the engine speed sensor 17, the vehicle speed sensor 18 and the accelerator pedal sensor 20 as input data. In this case, the detection signal of the engine speed sensor 17 is sent through the engine ECU 23 to the controller 24. In the step S2, the controller 24 calculates the actual engine speed N, the actual vehicle speed V and the actual depression of the accelerator pedal 19 based on the detection signals of the engine speed sensor 17, the vehicle speed sensor 18 and the accelerator pedal sensor 20, respectively. In the step S3, the controller 24 calculates the target vehicle speed Vo based on the calculated actual depression of the accelerator pedal 19. In the step S4, the controller 24 calculates the deviation Vd between the actual vehicle speed V and the target vehicle speed Vo. In the step S5, the controller 24 calculates the target engine speed No based on the deviation Vd between the actual vehicle speed V and the target vehicle speed Vo. In the step S6, the controller 24 generates a command signal for the target engine speed No to the engine ECU 23.

The calculation of the target engine speed No in the step S5 is performed according to the procedure that is shown by the part enclosed by dotted line in FIG. 2. Specifically, the deviation Vd between the target vehicle speed Vo and the actual vehicle speed V is inputted to a P term calculation section 30 and an I term integration section 31. The I term integration section 31 integrates the I term by integrating the present I term to the previous I term based on the deviation Vd and outputs to an I term calculation section 32 a signal indicative of the value of the integrated I term. The I term calculation section 32 calculates the I term from the input integrated value of the I term. A signal of the actual vehicle speed V is also inputted through a filter 33 to a P gain increase calculation section 34. The P gain increase calculation section 34 calculates the P gain increase value from the difference between the target vehicle speed Vo and the actual vehicle speed V passed through the filter 33 and mapped data previously prepared based on testing with respect to the actual engine speed N and outputs the calculated P gain increase value to the P term calculation section 30. The P term calculation section 30 calculates the P term from the deviation Vd and the P term gain increase value. The P term outputted from the P term calculation section 30 and the I term outputted from the I term calculation section 32 are added to calculate the target engine speed No.

That is, the controller 24 has the P term calculation section 30, the I term integration section 31 and the I term calculation section 32 which constitute an ordinary structure for determining the target engine speed by using PI control based on the deviation Vd between the target vehicle speed Vo and the actual vehicle speed V and further has the filter 33 and the P gain increase calculation section 34. According to the configuration described above, the P term is calculated by the P term calculation section 30 based on the P gain increased according to the actual engine speed N. The upper limit of the target engine speed No is so controlled according to the actual engine speed N that the target engine speed No becomes the sum of the actual engine speed N and a value $\alpha$.

During starting a vehicle or immediately after such starting a vehicle, the difference between the actual engine speed N and the target engine rotation No is large. The value $\alpha$ is determined according to data previously prepared based on testing so that excessive acceleration and overshoot of vehicle speed are prevented. Mapped data is made based on the value $\alpha$ and used when calculating the P gain increase value in the P gain increase calculation section 34. Although the value $\alpha$ varies with the rated load of the forklift trucks, the value $\alpha$ should be from 5 to 10 percents of the actual engine speed N.

Figure 4:
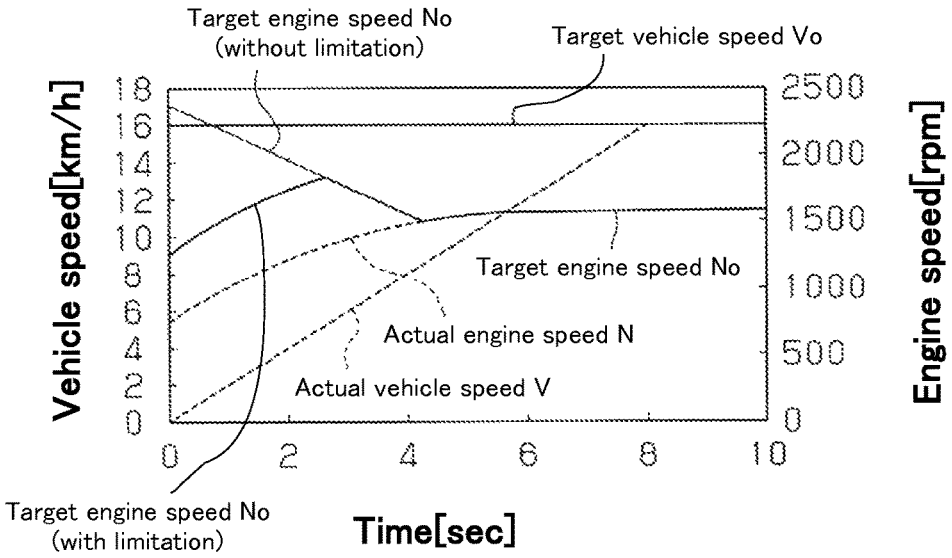
FIG. 4 is a graph showing the relation among a target vehicle speed, an actual vehicle speed, a target engine speed and an actual engine speed in the controlling by the vehicle speed control apparatus of FIG. 1.

In FIG. 4, the relation among the target vehicle speed, the actual vehicle speed, the target engine speed and the actual engine speed is shown with regard to a case that the target vehicle speed is 16 km/h and that the vehicle speed reaches the target vehicle speed in 8 seconds from a start. In the graph, the target engine speed (without limitation) corresponds to the target engine speed No that is determined by the conventional PI control based on the deviation Vd between the target vehicle speed Vo and the actual vehicle speed V. The target engine speed (with limitation) corresponds to the target vehicle speed Vo that is limited by considering the deviation between the target engine speed No and the actual engine speed N, which is determined by the PI control according to the present embodiment.

In FIG. 4, the dotted curve between zero-second position and approximately four-second position represents the actual engine speed that is required for load handling. After the four-second position, the actual engine speed coincides with the target engine speed. The solid curve between zero-second position and approximately 2.5 second position represents the target engine speed (with limitation). The downward sloping straight line represents the target engine speed (without limitation). After approximately 2.5 second position, the target engine speed (with limitation) coincides with the target engine speed (without limitation). That is, when the deviation between the target vehicle speed Vo and the actual vehicle speed V is large, the upper limit of the target engine speed No is controlled according to the actual engine speed N.

In the case that the target engine speed No is determined according to the conventional PI control based on the deviation Vd between the target vehicle speed Vo and the actual vehicle speed V, the difference between the target engine speed No and the actual engine speed N in starting a vehicle is too large with the result that, when the engine ECU 23 controls the engine 11 according to the target engine speed No, the engine speed may exceed the speed at which the vehicle travels at a proper vehicle speed or the vehicle may be excessively accelerated. However, the controller 24, which controls the upper limit of the target engine speed No according to the actual engine speed N, can prevent the vehicle from being excessively accelerated and overshoot of the vehicle speed while securing the engine speed required for load handling in the case that even when the deviation Vd between the target vehicle speed Vo and the actual vehicle speed V is large, for example, during starting of the vehicle. Therefore, the operator feels less rapid movement of the vehicle when starting the vehicle.

The present embodiment has the following advantageous effects. (1) The vehicle speed control apparatus of an industrial vehicle sets the upper limit of the target engine speed No according to the actual engine speed N when the target engine speed No is determined according to the PI control based on the deviation Vd between the target vehicle speed Vo and the actual vehicle speed V. Therefore, when the deviation Vd between the target vehicle speed Vo and the actual vehicle speed V is large, for example, when starting a vehicle, excessive acceleration and overshoot of vehicle speed can be prevented while ensuring the engine speed required for load handling.

(2) The target engine speed No is limited only when the difference between the target engine speed No and the actual engine speed N is large, for example when starting a vehicle. Therefore, during steady traveling of the vehicle when the difference between the target engine speed No and the actual engine speed N is small, the target engine speed No is not influenced by this limitation.

(3) When the operator drives the forklift truck 10 and performs load handling by inching operation or repeating start and stop, the target engine speed No increases according to the increase of the actual engine speed, so that the controller 24 commands to the engine ECU 23 a target engine speed No that is required for load handling.

(4) The controller 24 that forms a part of the vehicle speed control apparatus includes the P gain increase calculation section 34, the P term calculation section 30 that calculates the P term based on the deviation Vd between the target vehicle speed Vo and the actual vehicle speed V and the P gain increase value calculated in the P gain increase calculation section 34 and the I term calculation section 32 that calculates the I term based on the deviation Vd between the target vehicle speed Vo and the actual vehicle speed V. According to this configuration of the controller 24, when calculating the P term in the P term calculation section 30, the P term is calculated increasing the P gain according to the actual engine speed N. Therefore, the upper limit of the target engine speed No is controlled according to the actual engine speed N so that the target engine speed No becomes the sum of the actual engine speed N and the value $\alpha$. The value $\alpha$ is chosen based on data previously prepared through testing so that excessive acceleration and overshoot of vehicle speed are prevented when the difference between the actual engine speed N and the target engine rotation No increases during starting a vehicle. As a result, excessive acceleration and overshoot of vehicle speed can be prevented while ensuring the engine speed required for load handling.

The above-described embodiment may be modified in various ways as exemplified below. Load handling of the forklift truck 10 is not limited to lift operation, but it may be operation using tilt or roll clamp attachment.

The control valve 13 may be either an electric valve or a mechanical valve. In the case that the upper target engine speed No is limited according to the actual engine speed N, the upper target engine speed No may be limited according to the actual vehicle speed V based on the previously obtained data of relation between the actual vehicle speed V and the actual engine speed N which is obtained previously instead of using the actual engine speed N that is directly detected. During load handling by inching operation repeating start and stop, however, the limit needs not to be applied or such value $\alpha$ needs to be set that load handling can be performed satisfactorily in repeating start and stop.

The industrial vehicle is not limited to a forklift truck such as 10 but it may be a traction vehicle. In this case, a state that the traction vehicle has an object to be towed such as a trailer, corresponds to the load handling of the traction vehicle. The required power or the target engine speed No depends on the weight of the object to be towed.

The controller 24 may have a structure wherein detection signals of the engine speed sensor 17 may be sent directly to the controller 24 without transmission through the engine ECU 23.

It may be so configured that the controller 24 has the function of the engine ECU 23 that controls the engine 11. The engine 11 is not limited to a diesel engine, but it may be a gasoline engine. In this case, the value $\alpha$ is larger than in the case that a diesel engine is used.

The acceleration may be performed by means other than the accelerator pedal 19, but a manually-operated lever may be used.

What is claimed is:

1. A vehicle speed control apparatus of an industrial vehicle, with an engine as a power source for driving and load handling, the vehicle speed control apparatus comprising:

a controller configured to:

calculate a P gain increase value based on an actual engine speed and a difference between a target vehicle speed and an actual vehicle speed, calculate a P term based on the P gain increase value and the deviation between the target vehicle speed and the actual vehicle speed, and calculate an I term based on the deviation between the target vehicle speed and the actual vehicle speed, and wherein the controller determines a target engine speed by PI control controlling an upper limit of the target engine speed according to the actual engine speed.

2. The vehicle speed control apparatus of an industrial vehicle according to claim 1, wherein the industrial vehicle includes a diesel engine.

3. The vehicle speed control apparatus of an industrial vehicle according to claim 1, wherein the controller determines the target engine speed by PI control based on the deviation between the target vehicle speed and the actual vehicle speed, and the controller sets a sum of the actual engine speed and a value $\alpha$ as the target engine speed, the value $\alpha$ being set to 10% of the actual engine speed or less.

4. The vehicle speed control apparatus of an industrial vehicle according to claim 3, wherein the industrial vehicle includes a diesel engine.

* * * * *